US008434466B2

(12) United States Patent
Woods, Jr.

(10) Patent No.: US 8,434,466 B2
(45) Date of Patent: May 7, 2013

(54) BOW HUNTING ATTACHMENT FOR USE IN HUNTING ALLIGATORS

(76) Inventor: Lemuel Jackson Woods, Jr., Evans, GA (US)

( * ) Notice: Subject to any disclaimer, the term of this patent is extended or adjusted under 35 U.S.C. 154(b) by 381 days.

(21) Appl. No.: 12/381,500

(22) Filed: Mar. 12, 2009

(65) Prior Publication Data

US 2010/0229845 A1 Sep. 16, 2010

(51) Int. Cl.
*F41B 5/00* (2006.01)

(52) U.S. Cl.
USPC ..... 124/86

(58) Field of Classification Search ..... 124/86–88
See application file for complete search history.

(56) References Cited

U.S. PATENT DOCUMENTS

| | | | | | |
|---|---|---|---|---|---|
| 545,549 | A | * | 9/1895 | Strodel | 242/129.62 |
| 567,743 | A | * | 9/1896 | Griffith | 242/129.51 |
| 736,051 | A | * | 8/1903 | Adams | 124/24.1 |
| 982,361 | A | * | 1/1911 | Hedenstrom | 242/156.1 |
| 2,918,049 | A | * | 12/1959 | Stockfleth | 124/23.1 |
| 3,377,999 | A | * | 4/1968 | Reynolds | 124/88 |
| 3,556,428 | A | * | 1/1971 | Hayler et al. | 242/293 |
| 4,024,667 | A | * | 5/1977 | Wegener | 43/19 |
| 4,110,929 | A | * | 9/1978 | Weigand | 43/19 |
| 4,773,179 | A | * | 9/1988 | Corley | 43/19 |
| 4,788,961 | A | * | 12/1988 | Toth | 124/25.5 |
| 5,143,044 | A | * | 9/1992 | Bourquin | 124/88 |
| 5,746,382 | A | * | 5/1998 | Tsutsumi | 242/322 |
| 6,021,770 | A | * | 2/2000 | Sodaro | 124/89 |
| 2002/0198072 | A1 | | 12/2002 | LaSee | |
| 2003/0140912 | A1 | | 7/2003 | LaSee | |

OTHER PUBLICATIONS

The Robin Hood Archery Co.; titled "Continental Edition Catalog"; copyright 1967; Montclair, New Jersey, USA; copy enclosed (3 pages).

* cited by examiner

*Primary Examiner* — Gene Kim
*Assistant Examiner* — Amir Klayman
(74) *Attorney, Agent, or Firm* — Metz Lewis Brodman Must O'Keefe; Neal P. Pierotti

(57) ABSTRACT

A bow hunting attachment is provided that includes a mounting bracket configured for attachment to a bow. A spool is attached to the mounting bracket and has an outer surface a portion of which is configured for having a line wrapped thereon. A keeper is present and is configured for retaining the line onto the outer surface of the spool and is resilient so as to be capable of being displaced to allow the line to be removed from the outer surface of the spool upon firing of an arrow and pulling of the line that is attached to the arrow.

20 Claims, 10 Drawing Sheets

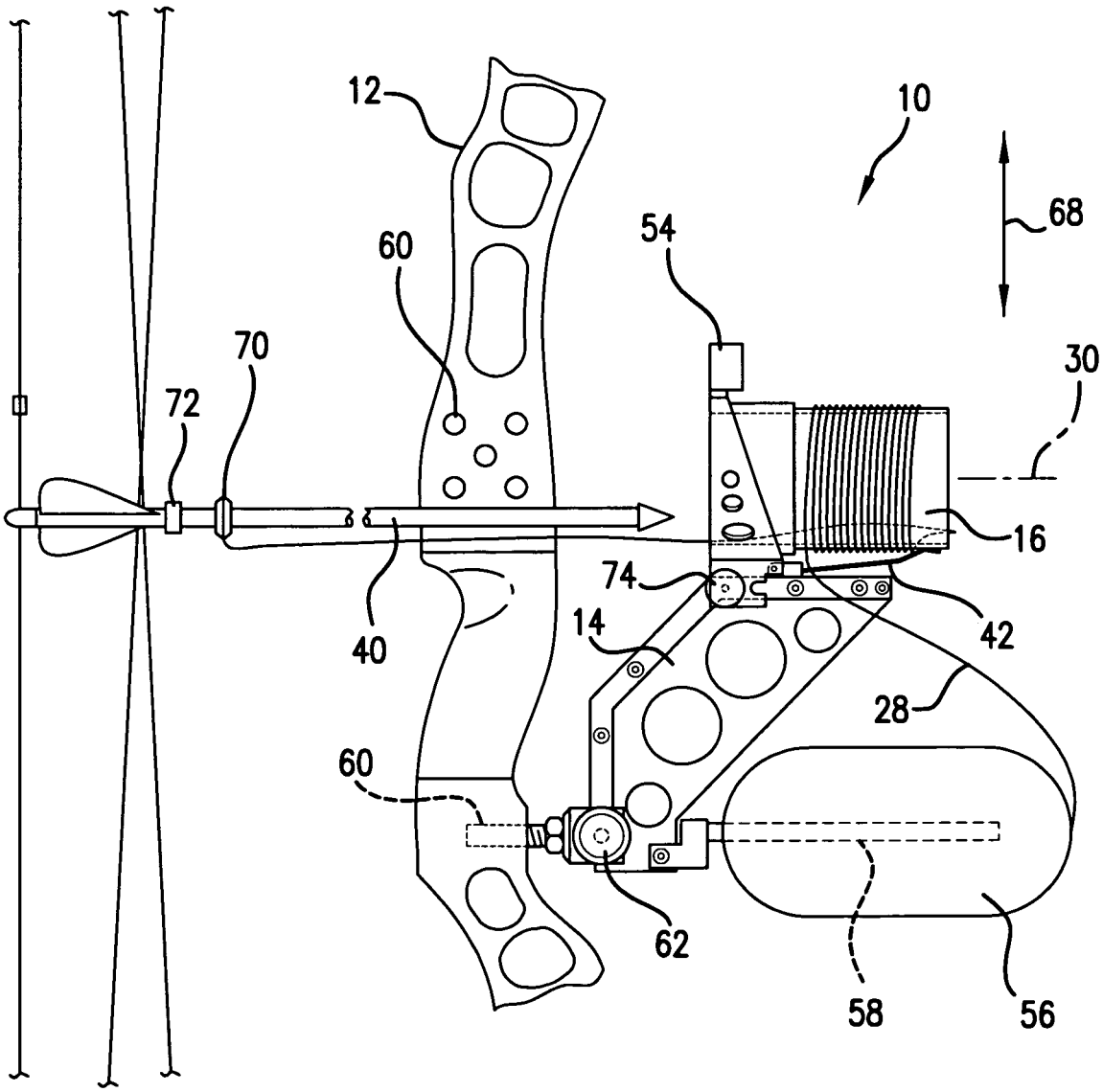
FIG.3
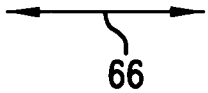

BOW HUNTING ATTACHMENT FOR USE IN HUNTING ALLIGATORS

FIELD OF THE INVENTION

The present invention relates generally to a device that is attached to a bow to aid in the hunting of big game. More particularly, the present application involves a bow hunting attachment that includes a spool onto which line is retained that allows an arrow attached to the line to be fired with minimal interference therewith.

BACKGROUND

Add on accessories are known and used with bows to provide additional functionality to allow bows to be used for specialized purposes. For example, it is known to provide a bow assembly with a reel that is mounted onto the bow. A line is attached to the arrow and can be fired at a target such as a fish. Upon striking the fish, the hunter can actuate the reel to draw in the line, arrow and fish. Although suitable for the hunting of fish, such a bow attachment may be undesirable when hunting larger game such as alligators. In this regard, a hunter may not want the reel and subsequently his or her bow attached to a line that is in turn attached to an alligator. A wounded alligator may still have sufficient strength to pull the bow from the grasp of the hunter thus depriving him or her of the bow.

Bow attachments are also known that include a spool onto which line is wound. The spool has mounting brackets that can be taped onto the bow in order to effect attachment between these two components. The spool has an axis that points generally towards the direction of flight of the arrow. The line is wound around an outer surface of the spool and the end of the spool is provided with a lip that prevents the line from sliding off of the outer surface of the spool. The spool has a hollow interior through which the arrow may be fired. The line is attached to the bow or to the spool and firing of the arrow causes the line to be unwound from the spool. As the line is attached to the spool or bow, pulling by the alligator may cause the bow to be pulled from the grasp of the user. Additionally, the lip on the outer surface of the end of the spool impedes the unwinding of the line from the spool which in turn induces a wobble into the arrow during flight. As the hide of an alligator is extremely thick, wobble of the arrow is undesirable in that it may not squarely strike the alligator and hence may not penetrate the hide of the alligator. As such, there remains room for variation and improvement in the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which:

FIG. 3 is a side view of the bow hunting attachment of FIG. 1 in which an adjustment mechanism is used to adjust the height of the bow hunting attachment relative to the bow.

Figure 1:
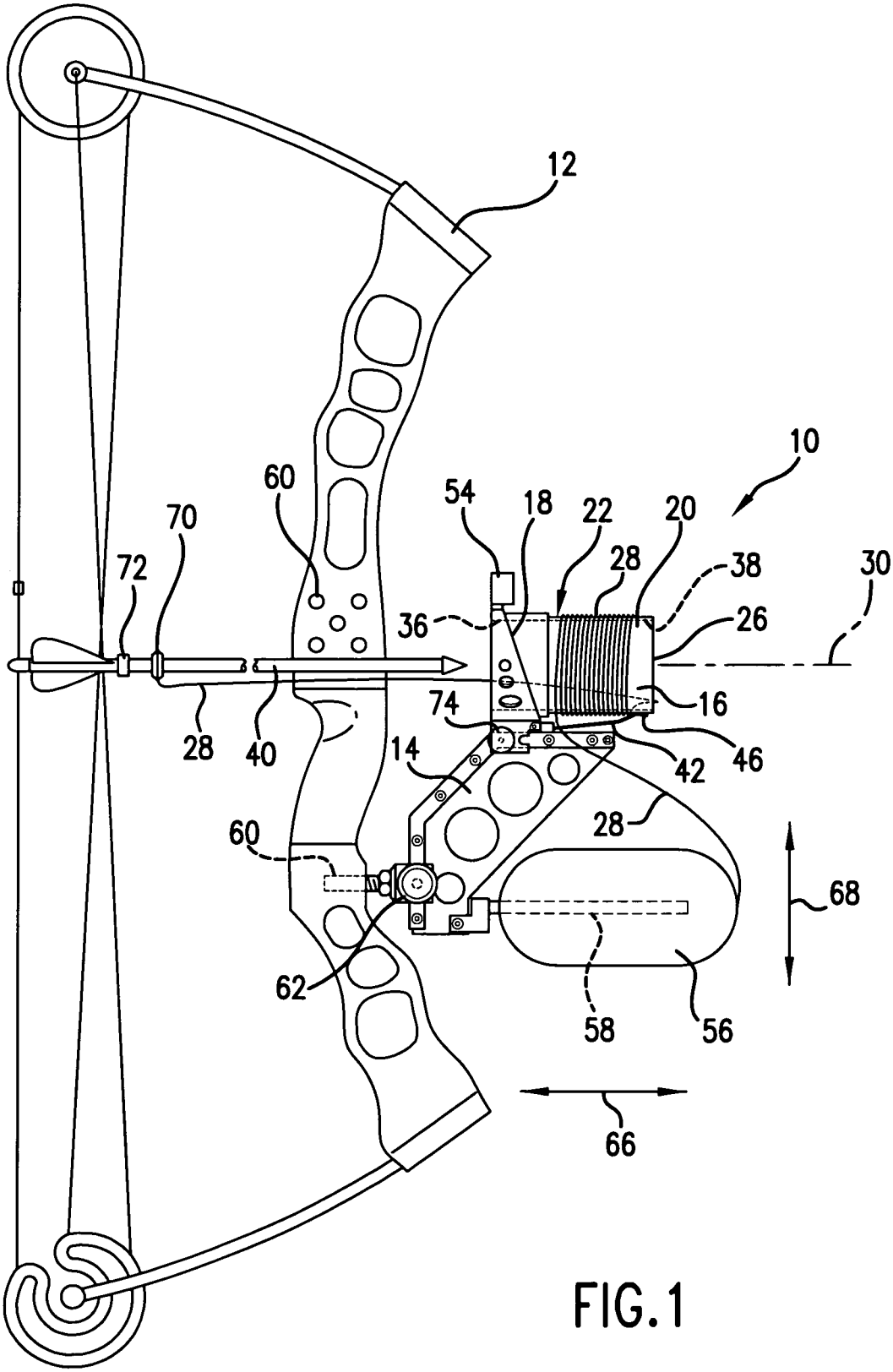
FIG. 1 is a side view of a bow hunting attachment attached to a bow in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a bow hunting attachment 10 that can be attached to a bow 12 to enhance functionality of the bow 12 while hunting big game such as alligators. The bow hunting attachment 10 includes a spool 16 onto which line 28 is wrapped. The spool 16 is arranged in such a manner that firing of an arrow 40 that is attached to the line 28 is not impeded during its flight from the bow 12 to the intended target. A keeper 42 can be included that functions to retain the line 28 onto the spool 16 during times when the bow 12 is moved but not fired. The keeper 42 is arranged so as to allow the line 28 to be pulled from the spool 16 as desired during shooting of the arrow 40.

One exemplary embodiment of the bow hunting attachment 10 is shown in FIG. 1 as being attached to a bow 12 that in this case is a compound bow. However, it is to be understood that the bow hunting attachment 10 may be attached to various types of bows 12 in accordance with other embodiments. The bow 12 can be provided to the user having a plurality of accessory features 60 disposed about its length. The accessory features 60 may be internally threaded holes or other attachment elements that can receive various accessories that a user desires to attach to the bow 12 such as a sight or an arrow nook. The bow hunting attachment 10 may be attached to the accessory feature 60 of the bow 12 through a threaded engagement. However, it is to be understood that various forms of attachment between the bow 12 and the bow hunting attachment 10 may be employed and the illustrated embodiment is only exemplary.

The bow hunting attachment 10 includes a mounting bracket 14 that is made of strong yet lightweight material such as fiberglass, plastic, or a composite material. In other embodiments, the mounting bracket 14 may be made out of steel, aluminum or other such metal. A series of apertures may be disposed through the mounting bracket 14 in order to function to reduce the weight of the mounting bracket 14. A spool 16 is mounted onto the top of the mounting bracket 14. Spool 16 has a generally circular outer circumference and a portion of the mounting bracket 14 extends around a portion of the spool 16. A base 18 of the spool 16 may be bolted or welded to the mounting bracket 14 at the bottom of base 18 and/or at the portion of the mounting bracket 14 that encircles the base 18. The spool 16 has an extension member 20 that extends from the base 18. Although described as being two separate components, the base 18 and extension member 20 may be integrally formed and can have identical cross-sectional sizes and shapes in accordance with other exemplary embodiments.

A line 28 is wrapped around an outer surface 22 of the extension member 20. The line 28 may be wrapped such that a single layer of line 28 is present along the outer surface 22 or may be wrapped one or more times so that multiple layers of the line 28 are present. A keeper 42 is present and functions to retain the line 28 to the outer surface 22. During normal use of the bow 12, the user, may raise, lower or move same that can cause the line 28 to fall off of the outer surface 22. The presence of keeper 42 functions to hold the line 28 onto the spool 16 during times when the arrow 40 is not fired. The keeper 42 may be a member that runs the length of the spool 16 and has an end portion 46 that is directed towards the outer surface 22. In this regard, the end portion 46 is spaced a lesser distance from the outer surface 22 than the remainder of the keeper 42 and in effect blocks the line 28 from moving between the outer surface 22 and the end portion 46 and hence off of the spool 16.

The arrow 40 is attached to the line 28 by way of a sliding member 70. The sliding member 70 can be moved up and down the length of the arrow 40 but is limited in this direction by a stop 72. The pointed tip of the arrow 40 may likewise limit the sliding of sliding member 70. However, other embodiments may be possible in which a pair of sliding members 72 are used instead of a single sliding member 72. Also, in yet other embodiments the connection between the arrow 40 and the line 28 need not be a sliding connection but may be instead a fixed connection. Connection of the arrow 40 and the line 28 allows the arrow 40 to be retrieved after firing. The opposite end of line 28 is attached to a float 56. Hunting of big game such as alligators may involve the firing of arrow 40 at the intended target which causes the line 28 and the float 56 to be pulled by the arrow 40 from the bow hunting attachment 10. A successful strike of the alligator by the arrow 40 may cause the alligator to dive into the water and become submerged in an effort to avoid the hunter. The float 56 will remain on the surface of the water and function as a marker for the hunter to ascertain the location of the alligator. The alligator may be shot with a subsequent arrow 40 once it resurfaces for air, or the line 28 may be pulled in to retrieve a dead or wounded alligator. The line 28 can be of various strengths and sizes as desired for the intended hunting application. The line 28 may be 200# braided line or 640# braided line in accordance with certain exemplary embodiments.

The keeper 42 therefore functions to hold the line 28 during use of the bow 12 but before discharge of the arrow 40, and to allow the line 28 to be removed from the spool 16 upon discharge of the arrow 40 by the user when firing at a target. The keeper 42 may be made of a resilient material such as spring steel so that sufficient force applied thereto will cause the keeper 42 to become displaced so as to allow the line 28 to be forced between the outer surface 22 and the keeper 42. In this regard, in the pre-firing state the keeper 42 need only apply pressure sufficient to hold the line 28 to the outer surface 22 and prevent same from sliding off. This pressure may be relatively light so that any amount of force applied by the line 28 through the firing process will be sufficient to bend the keeper 42 to allow the line 28 to be pulled from the spool 16.

Figure 2:
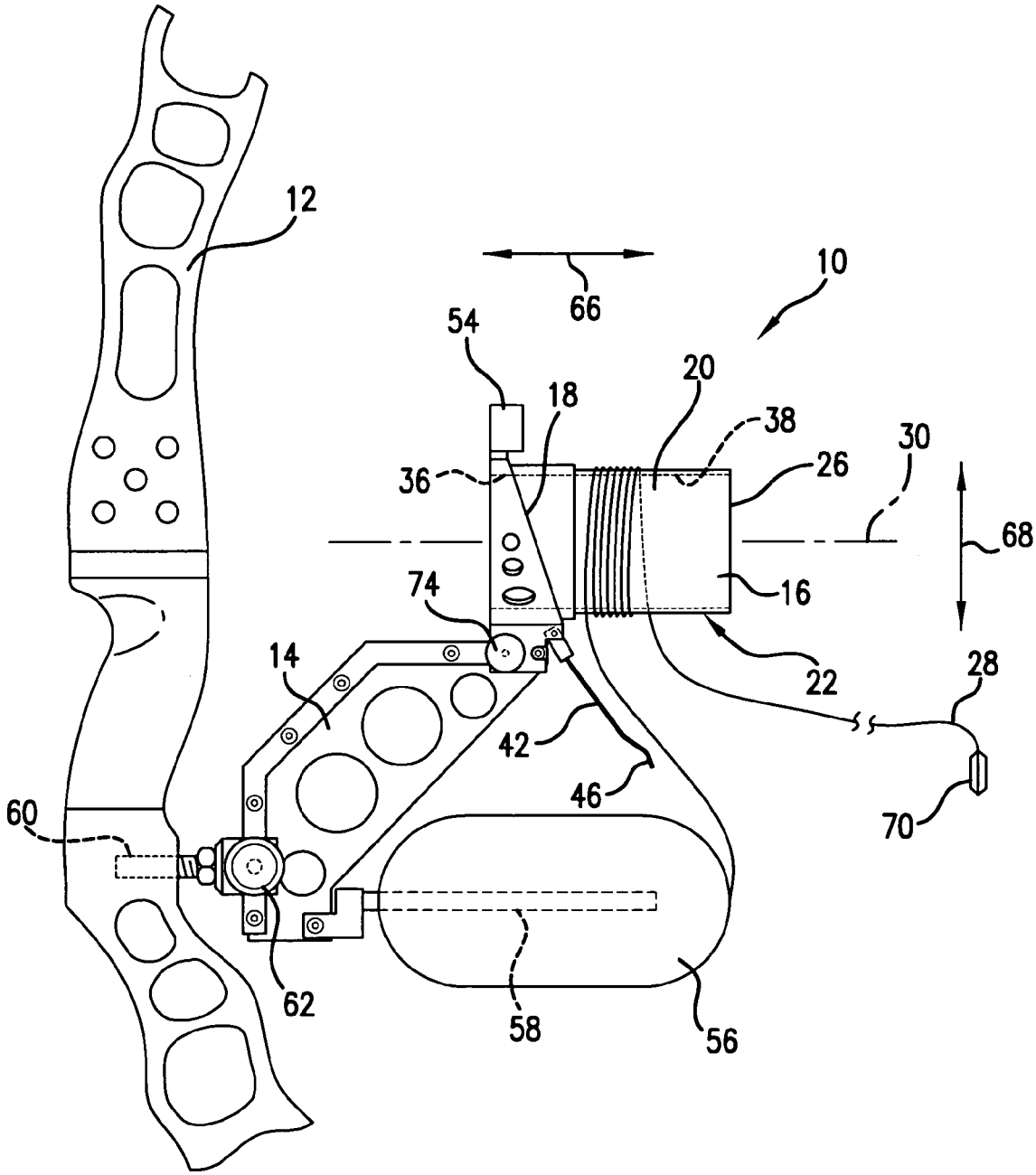
FIG. 2 is a side view of the bow hunting attachment of FIG. 1 in which a spool is displaced relative to a mounting bracket in order to wind line onto the spool.

FIG. 2 illustrates the bow hunting attachment 10 of FIG. 1 reconfigured for reloading of the line 28 onto the spool 16. Here, a sliding release mechanism 74 can be actuated so as to loosen a portion of the mounting bracket 14 to allow the spool 16 to be moved forward in the forward/rearward direction 66 away from the bow 12. The keeper 42 is pivotally attached to the mounting bracket 14 such that sliding of the spool 16 and keeper 42 forward provides clearance for the keeper 42 and allows same to pivot with respect to and hence be moved away from the outer surface 22. Such a configuration provides the user with clearance to allow him or her to rewind the line 28 back onto the outer surface 22. Once the line 28 has been properly wound thereon, the spool 16 and keeper 42 can be slid rearward in the forward/rearward direction 66 to cause the keeper 42 to again be pivoted towards the spool 16 and properly positioned so as to retain the line 28 onto the outer surface 22.

The bow hunting attachment 10 can be arranged and positioned so that the arrow 40 can be fired through the spool 16. Due to variances in the design of bows 12, an adjustment mechanism 62 may be provided that allows for a portion of the mounting bracket 14 to be adjusted upwards and downwards in the up/down direction 68 so that the spool 16 can be properly positioned. FIG. 3 shows actuation of the adjustment mechanism 62 in order to adjust a portion of the mounting bracket 14 and the spool 16 upwards in the up/down direction 68. It is to be understood that other arrangements of the bow hunting attachment 10 are possible in which the adjustment mechanism 62 is not present. Further, in accordance with additional exemplary embodiments the arrow 40 need not be shot through the spool 16.

Figure 4:
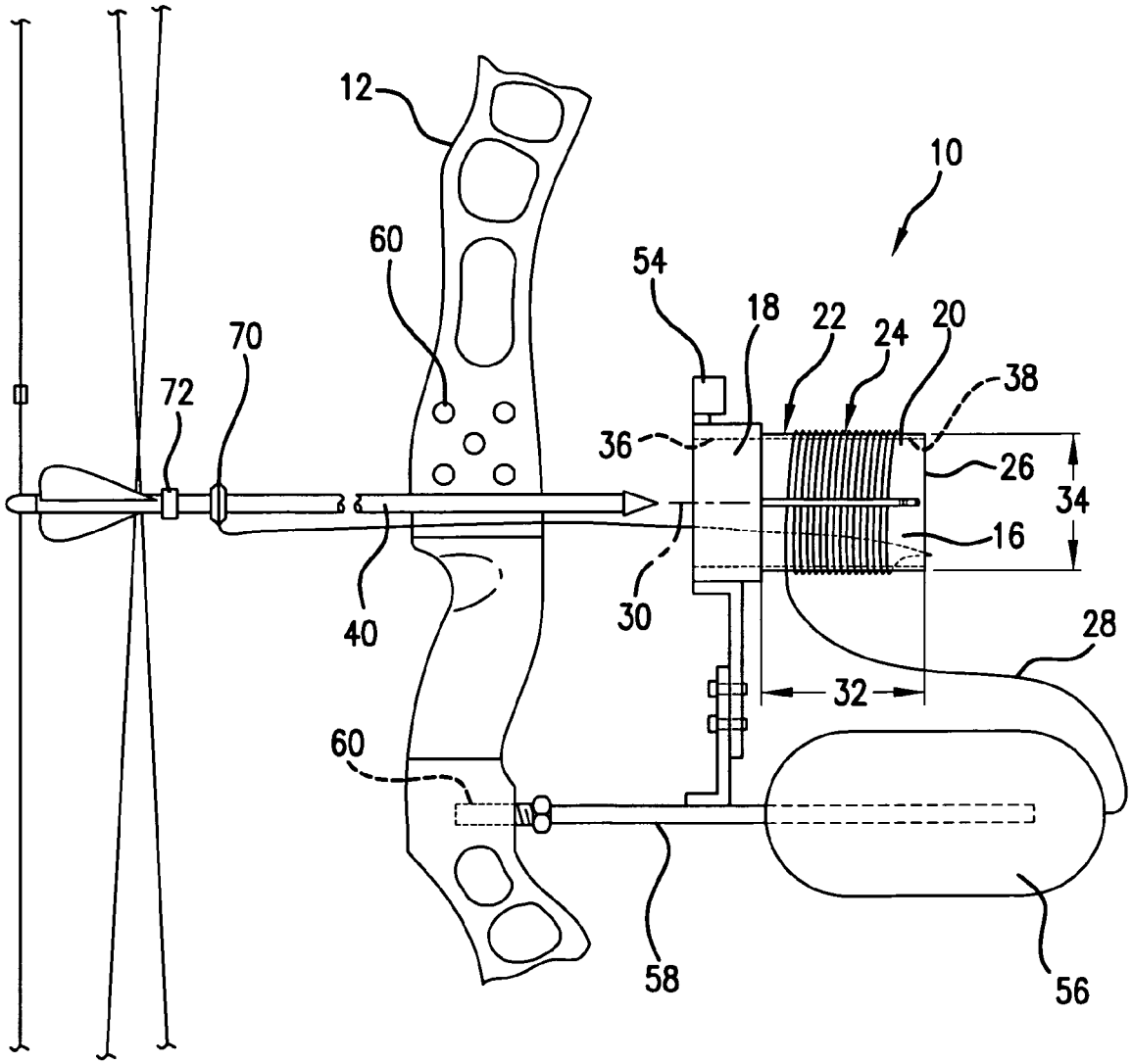
FIG. 4 is a side view of a bow hunting attachment attached to a bow in accordance with another exemplary embodiment.
Figure 5:
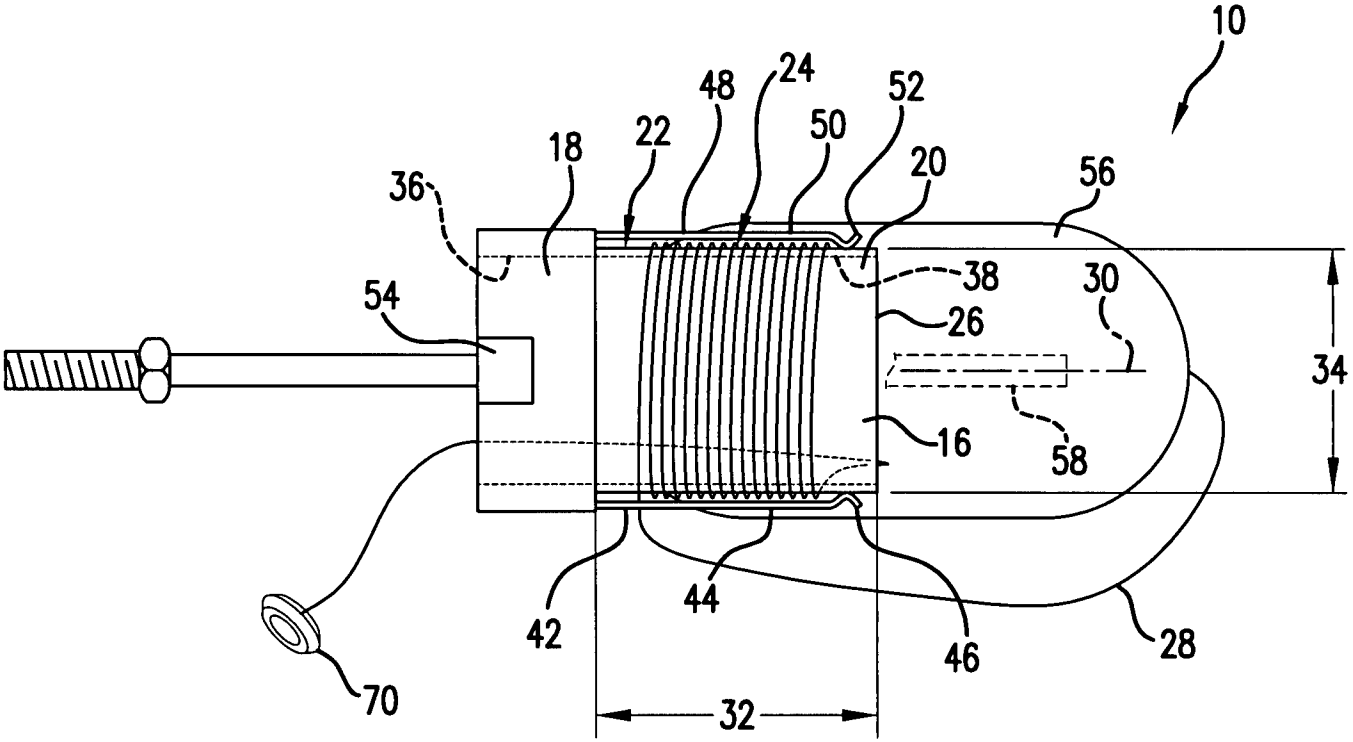
FIG. 5 is a top view of the bow hunting attachment of FIG. 4.
Figure 7:
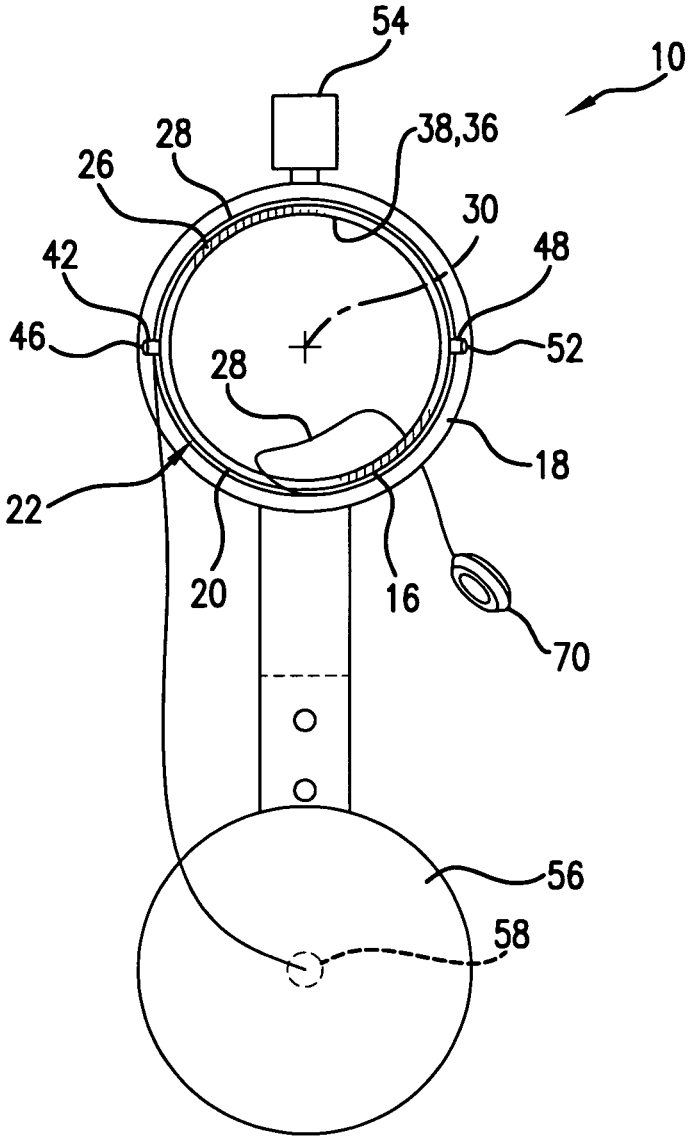
FIG. 7 is a front view of the bow hunting attachment of FIG. 5.

An alternative exemplary embodiment of the bow hunting attachment 10 is shown in FIGS. 4, 5 and 7. The base 18 has a hollow interior 36, and the extension member 20 likewise has a hollow interior 38. The base 18 and extension member 20 are hollow cylinders that are co-axial with one another. The outer diameter of the base 18 may be greater than the diameter 34 of the outer surface 22 of the extension member 20. However, it is to be understood that other exemplary embodiments exist in which the outer diameters of the base 18 and the extension member 20 are identical. The outer surface 22 may have a consistent diameter 34 from a location 24 where the line 28 is wrapped onto the outer surface 22 to the end 26 of the extension member 20. The distance from the location 24 where the line 28 is wrapped to end 26 may be designated by length 32. As such, the outer surface 22 along the entire length 32 has the same diameter 34. The extension member 20 can be provided so as not to include a lip or other raised feature at the end 26 or at another portion along the axial length of the outer surface 22. The outer surface 22 may be a smooth, straight surface. The arrangement of the outer surface 22 may allow for the line 28 to be removed from the outer surface 22 during firing of the arrow 40 such that the line 28 provides minimal interference to the flight of the arrow 40 and does not cause same to wobble during transit to the target. The hide of an alligator is especially thick which may prevent an arrow 40 that is wobbling from penetrating into and through the hide. The entire outer surface 22 of the extension member 20 may have the same diameter 34 in other embodiments regardless of whether a portion of the extension member 20 has line wrapped thereon.

The spool 16 can be provided so that the axial length of the spool 16 is greater than the diameter of the spool 16. In accordance with one exemplary embodiment, the length 32 of the spool 16 is seven inches and the diameter 34 is four inches. In accordance with other exemplary embodiments, the axial length of the spool 16 is from five to twelve inches and the diameter of the outer surface 22 onto which the line 28 is wound is from two to five inches. In accordance with other exemplary embodiments, the diameter 34 may be up to ten inches, and the length 32 may be up to twenty four inches. However, it is to be understood that the size and configuration of the spool 16 can be variously designed in accordance with other exemplary embodiments.

The exemplary embodiment illustrated in FIGS. 4, 5 and 7 includes a keeper 42 that is attached on one end to the base 18 of the spool 16. The keeper 42 may be 0.007 spring steel in accordance with one exemplary embodiment. The keeper 42 may have a circular cross-sectional shape or may have a rectangular cross-sectional shape in accordance with certain exemplary embodiments. The keeper 42 has a body 44 that extends from the base 18. The body 44 extends in such as manner so as to be located generally at the same distance from the outer surface 22 along a portion of the axial length of the extension member 20. The body 44 is located at such a distance from the outer surface 22 that the line 28 is not pressed between the outer surface 22 and the body 44. However, other arrangements are possible in which the line 28 is pressed onto the outer surface 22 by the body 44. The keeper 42 includes an end portion 46 that is located at the end of the body 44. The end portion 46 is curved towards the outer surface 22 such that the end portion 46 is located generally closer to the outer surface 22 than the body 44. The end portion 46 may be spaced from the outer surface 22 so that interference is present to prevent the line 28 from moving past the outer surface 22 and the end portion 46 if a threshold amount of force is not applied thereto. The end portion 46 is curved upwards at its very tip so as to facilitate the acceptance of line 28 during a rewinding procedure. The upwards curvature of the end portion 46 thus facilitates insertion of the line 28 back onto the outer surface 22 when the user rewinds the line 28 thereon.

A second keeper 48 is provided on the spool 16. The second keeper 48 has a body 50 that extends from the base 18 and has an end portion 52 located at the end of the body 50. The second keeper 48, along with the body 50 and end portion 52 of the second keeper 48, may be configured in the same manner as previously discussed with respect to the keeper 42, body 44 and end portion 46 and a repeat of this information is not necessary. The second keeper 48 can be located on a side of the outer surface 22 that is essentially opposite keeper 42. Provision of the base 18 and extension member 20 as hollow cylinders causes an axis 30 of the spool 16 to extend through both the base 18 and the extension member 20 that are coaxial with one another. The keeper 42 and the second keeper 48 may be positioned 180° from one another radially with respect to the axis 30. However, it is to be understood that the keepers 42 and 48 may be positioned from 90° to 180° from one another in accordance with various exemplary embodiments. Although shown and described as including a pair of keepers 42 and 48, it is to be understood that any number of keepers may be employed in accordance with various exemplary embodiments.

Figure 6:
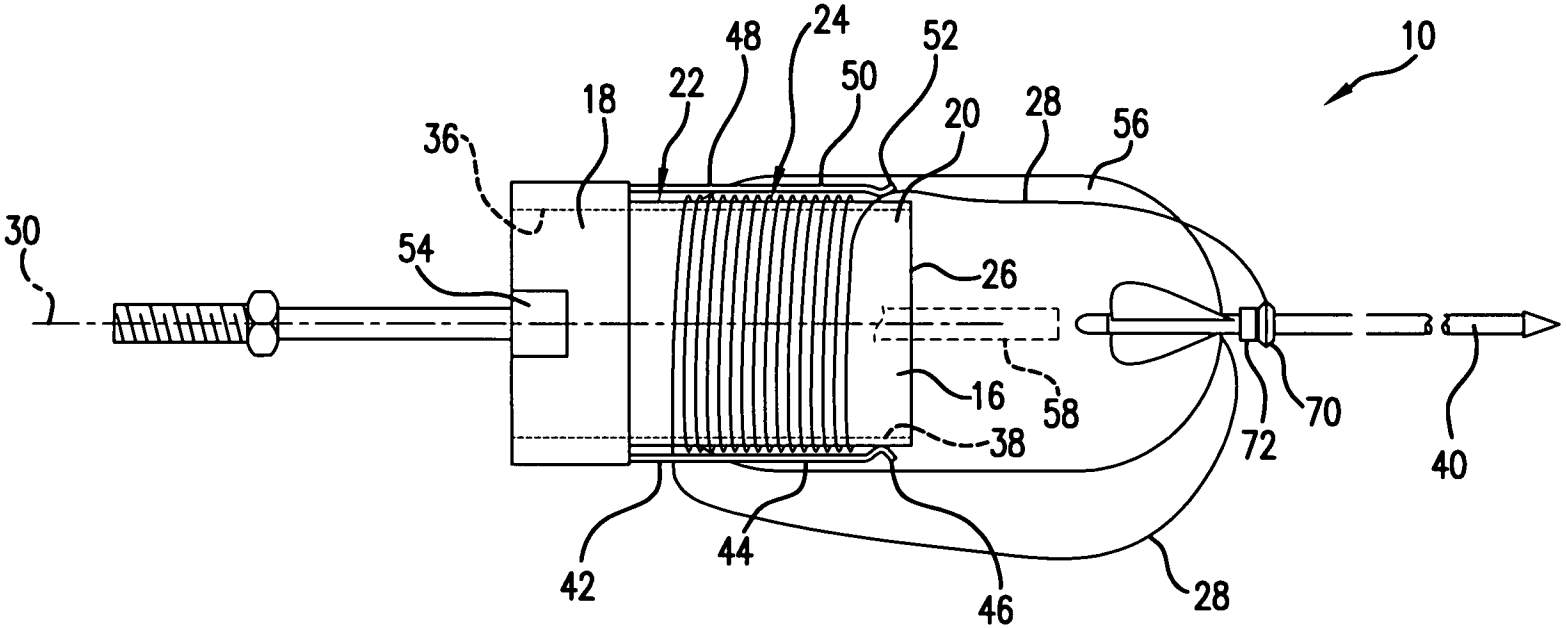
FIG. 6 is a top view of the bow hunting attachment of FIG. 5 that illustrates the firing of an arrow and the removal of line from the spool.

FIG. 6 illustrates the firing of an arrow 40 through the spool 16. Here, the arrow 40 is fired along axis 30 and causes attached line 28 to be pulled from the spool 16. Pulling of the attached line 28 past the second keeper 48 causes displacement of the end portion 52. In other arrangements of the bow hunting attachment 10, the body 50 in addition to the end portion 52 may be displaced when the line 28 traverses past the second keeper 48. The force applied by the bow 12 in firing the arrow 40 in combination with the resiliency, construction and arrangement of the second keeper 48 causes the line 28 to move past the second keeper 48 with negligible interference and hence negligible effect on the flight of the arrow 40. Although not shown explicitly in FIG. 6, the keeper 42 will be displaced in a similar manner as the second keeper 48 when the line 28 further unwinds and moves between the outer surface 22 and the keeper 42. The keeper 42 and the second keeper 48 are resilient such that once the line 28 is removed from the spool 16 they return to their normal, at rest positions. The user may then rewind the line 28 back onto the outer surface by displacing the end portions 46 and 52 away from the outer surface 22 when rewrapping the line 28.

A front sight 54 may be attached to the base 18 of the spool 16 to aid the user in firing the arrow 40 at the target. The front sight 54 may be attached to the mounting bracket 14 in accordance with other exemplary embodiments or may be absent from the bow hunting attachment 10 in yet further embodiments. The mounting bracket 14 may include a post 58 that receives the float 56. Float 56 may have a cavity that is slid onto the post 58 and retained thereon through a frictional engagement. Force applied by line 28 from flight of the arrow 40, or force applied by the line 28 when arrow 40 is embedded into a moving target such as an alligator is sufficient to overcome the frictional engagement between the float 56 and post 58 to cause these two elements to be disengaged. The mounting bracket 14 can be a rigid component that is not capable of being adjusted in either the forward/rearward direction 66 or the up/down direction 68. However, it is to be understood that the mounting bracket 14 can be adjustable in accordance with other embodiments so that the location of spool 16 in addition to other components of the bow hunting attachment 10 can be adjusted with respect to the bow 12.

Figure 8:
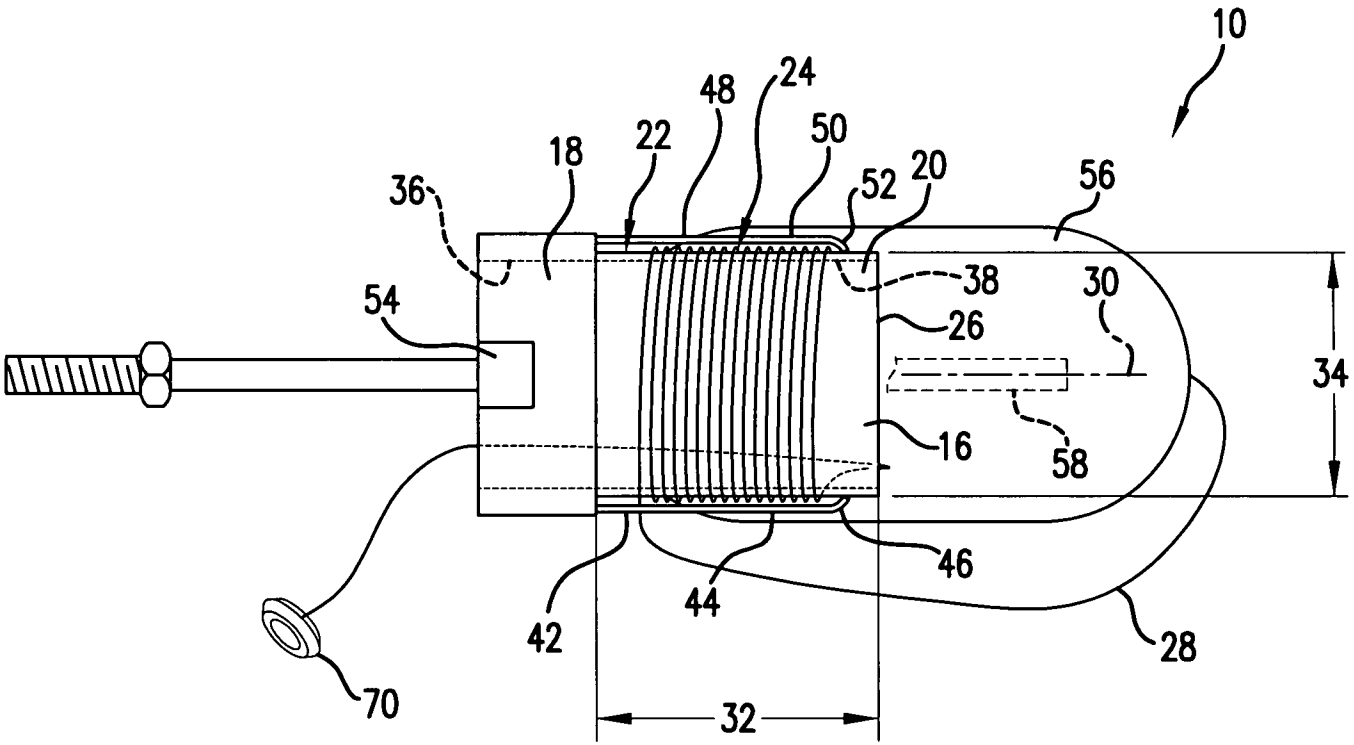
FIG. 8 is top view of a bow hunting attachment in accordance with another exemplary embodiment.

An alternative exemplary embodiment of the bow hunting attachment 10 is shown with reference to FIG. 8. Here, the bow hunting attachment 10 is configured in a manner similar to the embodiment of FIG. 5. The embodiment of FIG. 8 differs in that the keepers 42 and 48 have end portions 46 and 52 that do not have outer tips that extend away from the outer surface 22. In this regard, the end portions 46 and 52 extend towards the outer surface 22 and terminate at locations that are nearest to the outer surface 22 as compared to other portions of the bodies 44 and 50 and end portions 46 and 52 along the axial length 32.

Figure 9:
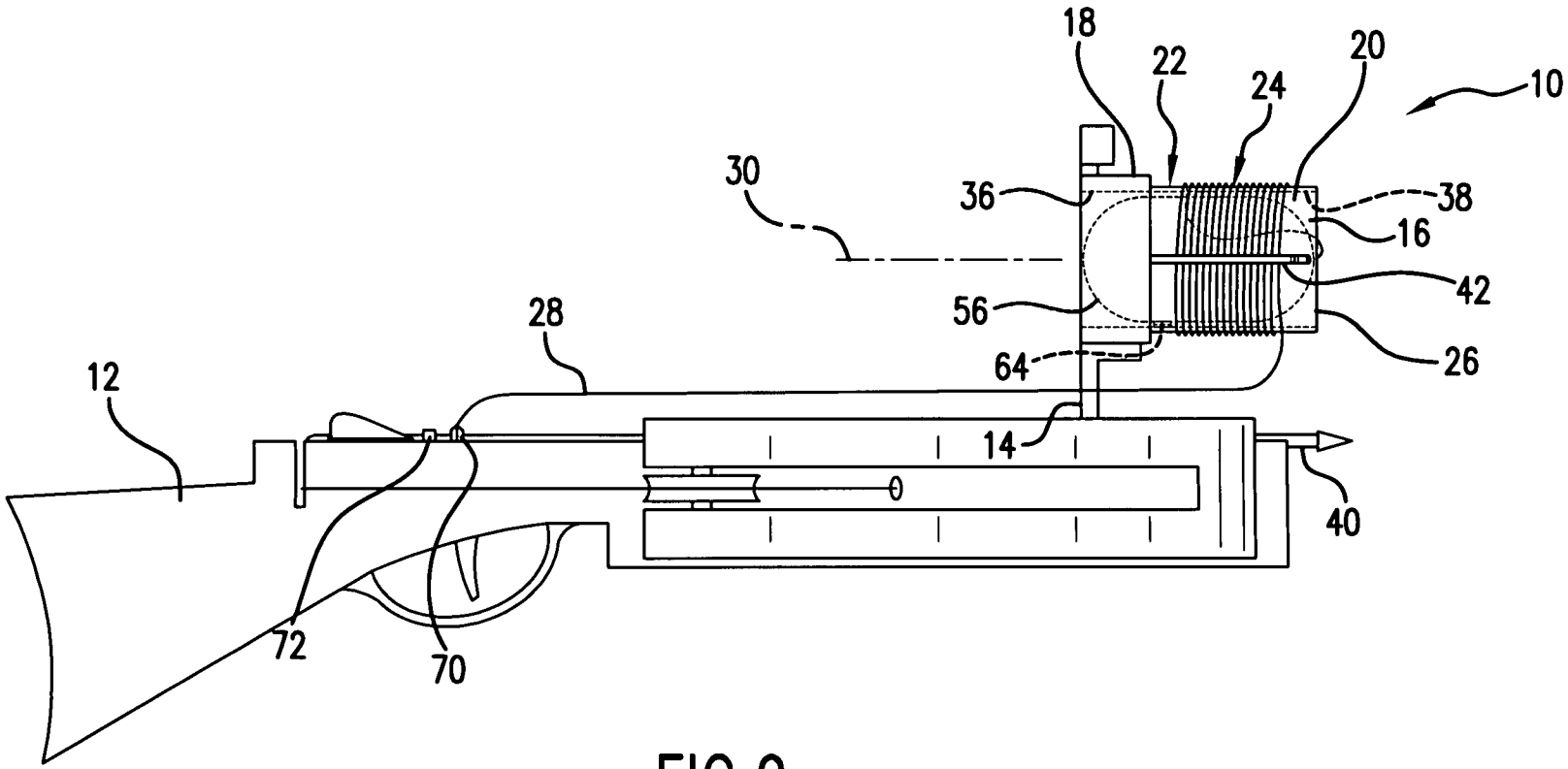
FIG. 9 is a side view of a bow hunting attachment that is attached to a bow that is a cross bow in accordance with another exemplary embodiment.

The bow hunting attachment 10 can be arranged so that the arrow 40 is not fired through the spool 16. FIG. 9 shows one exemplary embodiment in which the bow hunting attachment 10 is attached to a bow 12 that is a cross bow 12. The arrow 40 is fired below the spool 16 and does not move threthrough. The cross bow 12 may apply 150 pounds of pressure to the arrow 40 thus making negligible any drag caused by having the arrow 40 not traverse through the spool 16. However, it is to be understood that the bow hunting attachment 10 can be used with other bows 12, such as compound bows 12, in such a manner that the arrow 40 is not fired through the spool 16 and additional drag is imparted thereon. The spool 16 includes a base 18 that is attached to the mounting bracket 14. An extension member 20 extends from the base 18 and has an outer surface 22 that has a length 32 that has a consistent diameter 34. The base 18 and the extension member 20 have hollow interiors 36 and 38 into which the float 56 may be disposed. The float 56 may be positioned completely inside the interior of the spool 16 so that no portion of the float 56 extends axially beyond the axial length of the spool 16. In other arrangements the axial length of the float 56 extends beyond the axial length of the spool 16. A hook and loop attachment 64 is present to hold the float 56 to the interior of the spool 16. In this regard, one or more hook portions may be disposed onto the exterior of the float 56 and can engage one or more loop portions that are disposed on the inner wall of the hollow extension member 20. Upon firing of the cross bow 12, forces imposed upon the line 28 cause the hook and loop attachment 64 to become disengaged so that the float 56 is pulled from the spool 16. A keeper 42 and a second keeper 48 as previously disclosed may be included in the bow hunting attachment 10 to retain the line 28 to the spool 16.

Another exemplary embodiment exists in which the cross bow 12 of FIG. 9 is varied such that the arrow 40 is fired through the spool 16. In this arrangement, the spool 16 may be a hollow tube that has a larger diameter than the arrangement shown in FIG. 9. However, the tube diameter may be the same as the arrangement of FIG. 9 in other versions of the bow hunting attachment 10. The spool 16 can be attached to the cross bow 12 through the use of a mounting bracket 14 in one arrangement. The arrow 40 can thus be fired through the spool 16 so that resistive forces imparted by line 28 are reduced. The tip of the arrow 40 may be completely in back of the spool 16 so that the entire arrow 40 traverses through the spool 16 during firing of the cross bow 12. Alternatively, the spool 16 may be arranged so that some or all of the arrow 40 is located within or in front of the interior of spool 16 before the arrow 40 is fired. The float 56 can be located at a position that is vertically above the spool 16. The float 56 can be disposed onto the mounting bracket 14 or other portion of the bow hunting attachment 10 and can be positioned so that its placement does not interfere with the line of sight of the user when aiming and firing the cross bow 12. The float 56 may be directly above the spool 16 or can be located either forward or rearward of the spool 16 in various embodiments.

Figure 10:
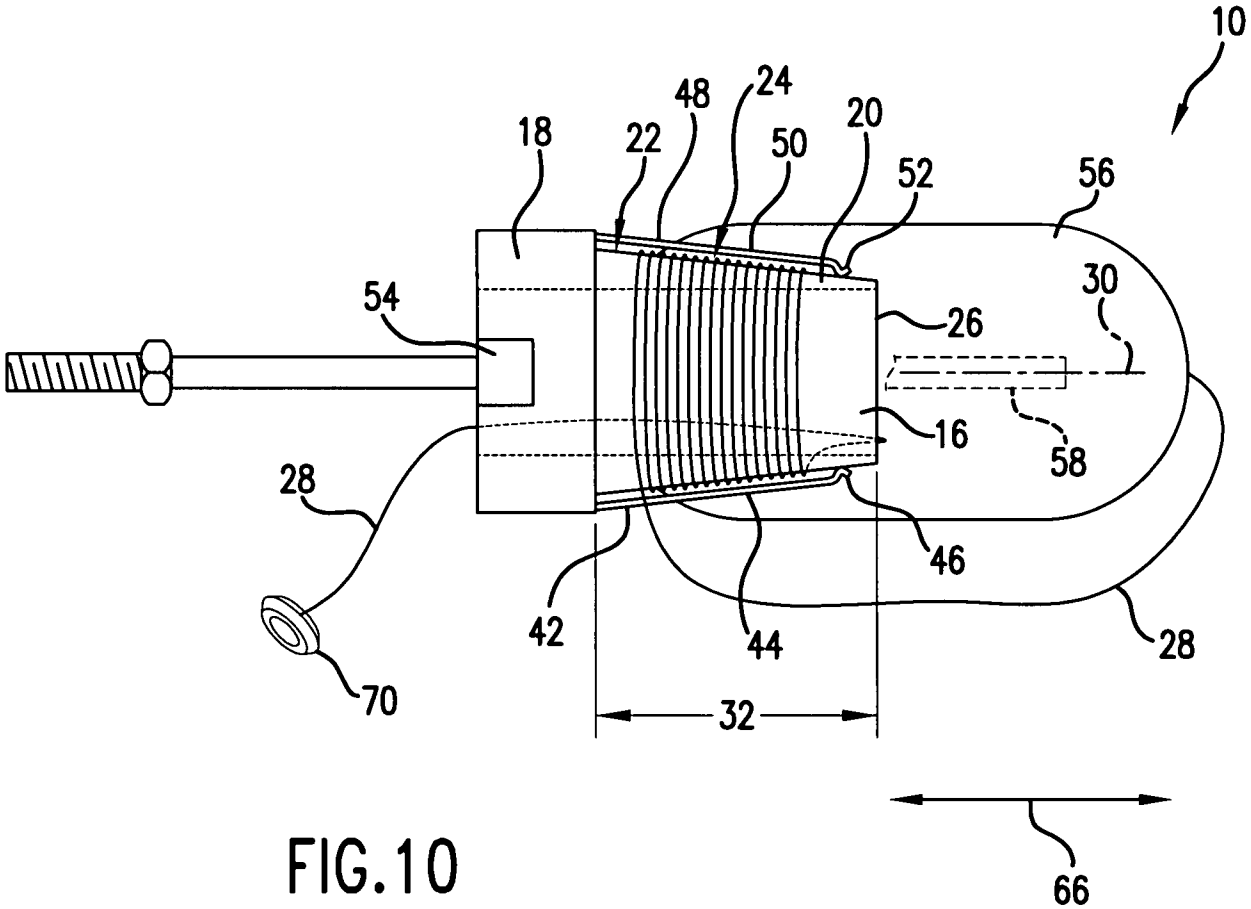
FIG. 10 is a top view of a bow hunting attachment that includes a tapered outer surface of the spool in accordance with another exemplary embodiment.

An alternative exemplary embodiment is shown in FIG. 10 in which the extension member 20 includes an outer surface 22 that is tapered. In this regard, the diameter 34 of the outer surface 22 becomes smaller in the forward direction of the forward/rearward direction 66. Thus, the diameter 34 at the end 26 may be smaller than the diameter 34 at the location 24 where the line 28 is wrapped onto the outer surface 22. The outer surface 22 may be tapered a constant amount or may be tapered at varying amounts along the length 32. The base 18 and the extension member 20 may have hollow interiors 36 and 38 that are coaxial and need not have inner walls that are tapered. The keeper 42 and second keeper 48 may be arranged so that they extend next to the tapered outer surface 22 to contain the line 28 thereon as previously discussed. The entire outer surface 22 of the extension member 20 may be tapered or only a portion of the outer surface 22 of the extension member 20 may be tapered. Further, the base 18 may have an outer surface that is or is not tapered in accordance with various exemplary embodiments. Further, the bodies 44 and 50 of the keepers 42 and 48 need not be parallel to the outer surface 22 but may instead extend at an angle thereto in accordance with certain exemplary embodiments.

Although described as having a base 18, it is to be understood that the base 18 and the extension member 20 may be integrally formed with one another and have the same cross-section and outer surface configuration in accordance with certain exemplary embodiments. The base 18 may be a portion of the extension member 20 that connects the spool 16 to the mounting bracket 14 and hence may be a small component or surface of the spool 16 in accordance with certain exemplary embodiments. Further, although described as being used in connection with the hunting of alligators, the bow hunting attachment 10 may also be used to hunt other animals such as fish, deer, birds, and bear in addition to use with other non-hunting archery applications.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A bow hunting attachment, comprising:

a mounting bracket configured for attachment to a bow; and a spool that has a base that is attached to the mounting bracket, wherein the spool has an extension member that extends from the base and is configured for having a line wrapped onto an outer surface thereof, wherein the outer surface of the extension member has a diameter at a location with the line wrapped thereon and engaging the outer surface that is greater than or equal to a diameter of the outer surface at a terminal end of the extension member, wherein the terminal end of the extension member is opposite an end of the extension member that engages the base in a forward/rearward direction, wherein the terminal end of the extension member is also a terminal end of the spool, wherein the outer surface of the extension member with the line wrapped thereon and engaging the outer surface is a smooth surface extending in the forward/rearward direction and is an exterior tapered surface of the extension member such that no other part of the extension member surrounds the outer surface and is tapered such that the diameter of the outer surface decreases in size in the forward direction towards the terminal end such that a first portion of the line wrapped around the outer surface is wrapped around a first portion of the outer surface that has a larger diameter than a second portion of the outer surface that is located forward from the first portion around which a second portion of the line at least one complete winding about the outer surface from the first portion of the line is wrapped, and wherein the second portion of the outer surface has a larger diameter than a third portion of the outer surface around which a third portion of the line that is at least one complete winding about the outer surface from the second portion of the line is wrapped that is located forward of the second portion of the outer surface, wherein the exterior tapered surface decreases in diameter and does not increase in diameter at any point in the forward direction from the most rearward point of engagement between the line and the exterior tapered surface to the terminal end.

2. The bow hunting attachment as set forth in claim 1, wherein the outer surface of the extension member that extends from the base to the terminal end of the extension member has a constant diameter.

3. The bow hunting attachment as set forth in claim 1, wherein the extension member is a hollow cylinder, wherein the length of the extension member is greater than the diameter of the outer surface of the extension member at the location with the line wrapped thereon.

4. The bow hunting attachment as set forth in claim 1, wherein the base and the extension member each have hollow interiors that are coaxial with one another and sized so as to allow an arrow to traverse therethrough, wherein the diameter of the outer surface of the extension member at the location with the line wrapped thereon is greater than the diameter of the outer surface at the terminal end of the extension member.

5. The bow hunting attachment as set forth in claim 1, further comprising a keeper that is configured for retaining the line onto the outer surface of the extension member, wherein the keeper is configured for allowing the line to be removed from the outer surface of the extension member after firing of an arrow and pulling of the line.

6. The bow hunting attachment as set forth in claim 5, wherein the keeper is a pair of spring steel members that are located on opposite sides of the extension member, wherein each of the spring steel members is spaced from the outer surface of the extension member and has an end portion that is closer to the outer surface of the extension member than the rest of the body of the spring steel member.

7. The bow hunting attachment as set forth in claim 5, wherein the keeper is mounted to the mounting bracket and is configured for pivoting with respect to the mounting bracket, wherein the spool is configured for being moved forward and rearward with respect to the mounting bracket so as to allow the keeper to pivot with respect to the mounting bracket.

8. The bow hunting attachment as set forth in claim 1, further comprising:

a front sight attached to the base; and a float retained onto the mounting bracket and attached to the line; and wherein the mounting bracket is configured for being attached to an accessory feature of the bow, wherein the mounting bracket has an adjustment mechanism that allows the spool and a portion of the mounting bracket to be adjusted up and down with respect to the bow.

9. The bow hunting attachment as set forth in claim 1, further comprising a float that is retained to an interior of the spool through a hook and loop type connection.

10. A bow hunting attachment, comprising:

a mounting bracket configured for attachment to a bow;

a spool that is attached to the mounting bracket, wherein the spool has an outer surface a portion of which is configured for having a line wrapped thereon; and a keeper that is configured for retaining the line onto the outer surface of the spool, wherein the keeper is resilient so as to be capable of being displaced to allow the line to be removed from the outer surface of the spool upon firing of an arrow and pulling of the line that is attached to the arrow;

wherein the spool has a terminal end, and wherein when the line is removed from the outer surface of the spool the line moves across the terminal end away from the spool forward in a forward/rearward direction;

wherein a first portion of the line that is retained on the outer surface of the spool engages the keeper before being removed from the outer surface of the spool at a location that is rearward from the terminal end of the spool in the forward/rearward direction, wherein when the first portion of the line engages the keeper a second portion of the line that is retained on the outer surface of the spool is located rearward from the point of engagement between the first portion of the line and the keeper in the forward/rearward direction and is located between the outer surface of the spool and the keeper, wherein the second portion of the line is located at least two 360 degree windings completely about the outer surface of the spool rearward from the first portion of the line, wherein the at least two windings of the line are located between a body of the keeper and the outer surface of the spool and engage the outer surface of the spool, and wherein the body of the keeper is located at such a distance from the outer surface that the at least two windings of the line are not pressed between the outer surface and the body of the keeper.

11. The bow hunting attachment as set forth in claim 10, wherein the spool has a base that is attached to the keeper, wherein a body of the keeper extends from the base and is spaced a distance from the outer surface of the spool, wherein the keeper has an end portion that located closer to the outer surface of the spool than the body of the keeper.

12. The bow hunting attachment as set forth in claim 11, further comprising a second keeper that has a body that extends from the base of the spool and is spaced a distance from the outer surface of the spool, wherein the second keeper has an end portion that is located closer to the outer surface of the spool than the body of the second keeper.

13. The bow hunting attachment as set forth in claim 12, wherein the outer surface of the spool is curved and has a constant diameter that extends in an axial direction of the spool along the portion of the spool onto which the line is wrapped, wherein the keeper and the second keeper are located 180° from one another with respect to an axis that extends through the spool.

14. The bow hunting attachment as set forth in claim 10, wherein the keeper is made of spring steel and has a body and an end portion, wherein the end portion is located closer to the spool than the body, wherein the end portion of the keeper engages the outer surface of the spool.

15. The bow hunting attachment as set forth in claim 10, wherein the outer surface of the spool tapers in the direction away from the bow when the mounting bracket is attached to the bow such that a diameter of the outer surface decreases in the direction away from the bow when the mounting bracket is attached to the bow.

16. The bow hunting attachment as set forth in claim 10, wherein the outer surface of the spool has a constant diameter from the portion configured for having the line wrapped thereon to the terminal end of the spool.

17. The bow hunting attachment as set forth in claim 10, wherein the spool has an extension member that is a hollow cylinder, wherein the portion of the outer surface of the spool configured for having the line wrapped thereon is located at the outer surface of the extension member, wherein the length of the extension member is greater than the diameter of the outer surface of the extension member at the portion configured for having the line wrapped thereon.

18. The bow hunting attachment as set forth in claim 10, wherein the spool has a base that is mounted to the mounting bracket, and wherein the keeper is mounted to the mounting bracket and is configured for pivoting with respect to the mounting bracket, wherein the spool is configured for being moved forward and rearward with respect to the mounting bracket so as to allow the keeper to pivot with respect to the mounting bracket.

19. The bow hunting attachment as set forth in claim 10, further comprising:

a front sight attached to the spool; and a float retained onto the mounting bracket and attached to the line;

wherein the mounting bracket is configured for being attached to an accessory feature of the bow, wherein the mounting bracket has an adjustment mechanism that allows the spool and a portion of the mounting bracket to be adjusted up and down with respect to the bow.

20. A bow hunting attachment, comprising:

a mounting bracket configured for attachment to an accessory feature of a bow;

a spool that has a base that is attached to the mounting bracket, wherein the spool has an extension member that extends from the base and is configured for having a line wrapped onto an outer surface thereof, wherein the outer surface of the extension member has a diameter at a location with the line wrapped thereon and engaging the outer surface that is greater than a diameter of the outer surface at a terminal end of the extension member, wherein the extension member has an overall length in the axial direction that is greater than the diameter of the outer surface of the extension member at the location with the line wrapped thereon, wherein the terminal end of the extension member is opposite an end of the extension member that engages the base in a forward/rearward direction, wherein the terminal end of the extension member is also a terminal end of the spool;

a keeper that is configured for retaining the line onto the outer surface of the extension member, wherein the keeper is resilient so as to be capable of being displaced to allow the line to be removed from the outer surface of the extension member upon firing of an arrow and pulling of the line that is attached to the arrow, wherein the keeper engages the outer surface of the extension member, and wherein the line that is retained on the outer surface of the extension member rearward from the point of engagement between the keeper and the outer surface of the extension member in the forward/rearward direction has a portion that is located at least two 360 degree windings completely about the outer surface of the extension member rearward from the point of engagement between the keeper and the outer surface of the extension member and is located between the keeper and the outer surface of the extension member, wherein the at least two windings of the line are located between a body of the keeper and the outer surface of the extension member and engage the outer surface of the extension member, and wherein the body of the keeper is located at such a distance from the outer surface that the at least two windings of the line are not pressed between the outer surface and the body of the keeper; and a float retained onto the mounting bracket and attached to the line.

* * * * *